US008725503B2

(12) United States Patent
Bessette

(10) Patent No.: US 8,725,503 B2
(45) Date of Patent: May 13, 2014

(54) FORWARD TIME-DOMAIN ALIASING CANCELLATION WITH APPLICATION IN WEIGHTED OR ORIGINAL SIGNAL DOMAIN

(75) Inventor: Bruno Bessette, Sherbrooke (CA)

(73) Assignee: VoiceAge Corporation, Town of Mount Royal, Québec (CA)

( * ) Notice: Subject to any disclaimer, the term of this patent is extended or adjusted under 35 U.S.C. 154(b) by 397 days.

(21) Appl. No.: 12/821,936

(22) Filed: Jun. 23, 2010

(65) Prior Publication Data

US 2011/0153333 A1 Jun. 23, 2011

Related U.S. Application Data

(60) Provisional application No. 61/213,593, filed on Jun. 23, 2009.

(51) Int. Cl.
*G10L 19/02* (2013.01)
*G10L 21/00* (2013.01)

(52) U.S. Cl.
USPC ..... 704/229; 704/201; 704/200

(58) Field of Classification Search
USPC ..... 704/200, 200.1, 201, 211, 229
See application file for complete search history.

(56) References Cited

U.S. PATENT DOCUMENTS 6,134,518 A * 10/2000 Cohen et al. ..... 704/201
6,314,393 B1 11/2001 Zheng et al.
6,475,245 B2 * 11/2002 Gersho et al. ..... 704/208
2004/0024588 A1 * 2/2004 Watson et al. ..... 704/200.1
2005/0185850 A1 8/2005 Vinton et al.
2009/0299757 A1 12/2009 Guo et al.
2011/0173011 A1 7/2011 Geiger et al.
2011/0257981 A1 10/2011 Beack et al.

FOREIGN PATENT DOCUMENTS

CN 101 23 1850 7/2008
EP 2 144 171 1/2010
WO WO2005114654 * 1/2005 ..... G01L 19/24
WO WO2008089705 * 7/2008 ..... G01L 19/00

OTHER PUBLICATIONS

Lecomte et al., "Efficient cross-fade windows for transitions between LPC-based and on-LPC based audio coding", 126th Audio Engineering Society Convention, Munich, Germany, Paper 7712, May 2009, pp. 1-9.

Princen et al., "Anaylsis/Synthesis Filter Bank Design Based on Time Domain Aliasing Cancellation", IEEE Transactions on Acoustics, Speech and Signal Processing, vol. ASSP-34, No. 5, Oct. 1986, pp. 1153-1161.

(Continued)

*Primary Examiner* — Jesse Pullias
(74) *Attorney, Agent, or Firm* — Fay Kaplun & Marcin, LLP

(57) ABSTRACT

The present invention relates to methods and devices for forward time-domain aliasing cancellation in a coded signal transmitted from a coder to a decoder. Information related to correction of the time-domain aliasing in the coded signal is calculated at the coder and added in a bitstream sent from the coder to the decoder. The decoder receives the bitstream and cancels the time-domain aliasing in the coded signal in response to the information comprised in the bitstream. The information may be representative of a difference between a frame of audio signal to be encoded in a first coding mode and a decoded signal from the frame including time-domain aliasing effects.

34 Claims, 17 Drawing Sheets

(56) References Cited

OTHER PUBLICATIONS

Ferreira, "Convolutional Effects in Transform Coding with TDAC: An Optimal Window", IEEE Transactions on Speech and Audio Processing, vol. 4, No. 2, Mar. 1996, pp. 104-114.

Princen et al., "Subband/Transform Coding Using Filter Bank Designs Based on Time Domain Aliasing Cancellation", IEEE International Conference on Acoustics, Speech and Signal Processing, vol. 12, 1987, pp. 2161-2164.

Neuendorf et al., "A Novel Scheme for Low Bitrate Unified Speech and Audio Coding-MPEG RM0", 126$^{th}$ Audio Engineering Society Convention, Munich, Germany, Paper 7713, May 7, 2009, pp. 1-13.

Neuendorf et al., "Unified Speech and Audio Coding Scheme for High Quality at Low Bitrates", IEEE International Conference on Acoustics, Speech and Signal Processing, 2009, pp. 1-4.

Bessette et al., "Universal Speech/Audio Coding Using Hybrid ACELP/TCX Techniques" ICASSP '05 IEEE International Conference, vol. 3, Mar. 2005, pp. 301-304.

3GPP TS 26.290 V1.0.0 ,3$^{rd}$ Generation Partnership Project, Technical Specification Group Service and System Aspects; Audio Codec Processing Functions; Extended AMR Wideband Codec; Transcoding Functions, Release 6, Jun. 2004, pp. 1-72.

International Standard, ISO/IEC 14496-3, Third Edition 2005, Information Technology—Coding of Audio Visual Objects—Part 3: Audio, 1178 sheets.

Information Technology—MPEG Audio Technologies—Part 3: Unified Speech and Audio Coding, 2010, 152 sheets.

* cited by examiner (FAC QUANTIZATION INCLUDING TCX ERROR CORRECTION)

FORWARD TIME-DOMAIN ALIASING CANCELLATION WITH APPLICATION IN WEIGHTED OR ORIGINAL SIGNAL DOMAIN

CROSS-REFERENCE TO RELATED APPLICATION

This application claims the benefit of U.S. provisional patent application No. 61/213,593 filed on Jun. 23, 2009 in the name of Bruno Bessette. The disclosure of this U.S. provisional patent application is herein incorporated by reference.

TECHNICAL FIELD

The present invention relates to the field of encoding and decoding audio signals. More specifically, the present invention relates to a device and method for time-domain aliasing cancellation using transmission of additional information.

BACKGROUND

State-of-the-art audio coding uses time-frequency decomposition to represent the signal in a meaningful way for data reduction. Specifically, audio coders use transforms to perform a mapping of the time-domain samples into frequency-domain coefficients. Discrete-time transforms used for this time-to-frequency mapping are typically based on kernels of sinusoidal functions, such as the Discrete Fourier Transform (DFT) and the Discrete Cosine Transform (DCT). It can be shown that such transforms achieve "energy compaction" of the audio signal. This means that, in the transform (or frequency) domain, the energy distribution is localized on fewer significant coefficients than in the time-domain samples. Coding gains can then be achieved by applying adaptive bit allocation and suitable quantization to the frequency-domain coefficients. At the receiver, the bits representing the quantized and encoded parameters (for example, the frequency-domain coefficients) are used to recover the quantized frequency-domain coefficients (or other quantized data such as gains), and the inverse transform generates the time-domain audio signal. Such coding schemes are generally referred to as transform coding.

By definition, transform coding operates on consecutive blocks of samples of the input audio signal. Since quantization introduces some distortion in each synthesized block of audio signal, using non-overlapping blocks may introduce discontinuities at the block boundaries, which may degrade the audio signal quality. Hence, in transform coding, to avoid discontinuities, the encoded blocks of audio signal are overlapped prior to applying the discrete transform, and appropriately windowed in the overlapping segment to allow smooth transition from one decoded block to the next. Using a "standard" transform such as the DFT (or its fast equivalent, the FFT) or the DCT and applying it to overlapped blocks unfortunately results in what is called "non-critical sampling". For example, taking a typical 50% overlap condition, encoding a block of N consecutive time-domain samples actually requires taking a transform on 2N consecutive samples—N samples from the present block and N samples from the next block overlapping part). Hence, for every block of N time-domain samples, 2N frequency-domain coefficients are encoded. Critical sampling in the frequency domain implies that N input time-domain samples produce only N frequency-domain coefficients to be quantized and coded.

Specialized transforms have been designed to allow the use of overlapping windows and still maintain critical sampling in the transform-domain—2N time-domain samples at the input of the transform result in N frequency-domain coefficients at the output of the transform. To achieve this, the block of 2N time-domain samples is first reduced to a block of N time domain samples through special time inversion and summation of specific parts of the 2N-sample long windowed signal. This special time inversion and summation introduces what is called "time-domain aliasing" or TDA. Once this aliasing is introduced in the block of signal, it cannot be removed using only that block. It is this time-domain aliased signal that is the input of a transform of size N (and not 2N), producing the N frequency-domain coefficients of the transform. To recover N time-domain samples, the inverse transform actually has to use the transform coefficients from two consecutive and overlapping frames to cancel out the TDA, in a process called Time-domain aliasing cancellation, or TDAC.

An example of such a transform applying TDAC, which is widely used in audio coding, is the Modified Discrete Cosine Transform (or MDCT). Actually, the MDCT performs the above mentioned TDA without explicit folding in the time domain. Rather, time-domain aliasing is introduced when considering both the direct and inverse MDCT (IMDCT) of a single block. This comes from the mathematical construction of the MDCT and is well known to those of ordinary skill in the art. But it is also known that this implicit time-domain aliasing can be seen as equivalent to first inverting parts of the time-domain samples and adding (or subtracting) these inverted parts to other parts of the signal. This is known as "folding".

A problem arises when an audio coder switches between two coding models, one using TDAC and the other not. Suppose for example that a codec switches from a TDAC coding model to a non-TDAC coding model. The side of the block of samples encoded using the TDAC coding model, and which is common to the block encoded without using TDAC, contains aliasing which cannot be cancelled out using the block of samples encoded using the non-TDAC coding model.

A first solution is to discard the samples which contain aliasing that cannot be cancelled out.

This solution results in an inefficient use of transmission bandwidth because the block of samples for which TDA cannot be cancelled out is encoded twice, once by the TDAC-based codec and a second time by the non-TDAC based codec.

A second solution is to use specially designed windows which do not introduce TDA in at least one part of the window when the time inversion and summation process is applied. FIG. 1 is a diagram of an exemplary window introducing TDA on its left side but not on its right side. More specifically, in FIG. 1, a 2N-sample window 100 introduces TDA 110 on its left side. The window 100 of FIG. 1 is useful for transitions from a TDAC-based codec to a non-TDAC based codec. The first half of this window is shaped so that it introduces TDA 110, which can be cancelled if the previous window also uses TDA with overlapping. However, the right side of the window in FIG. 1 has a zero-valued sample 120 after the folding point at position 3N/2. This part of the window 100 therefore does not introduce any TDA when the time-inversion and summation (or folding) process is performed around the folding point at position 3N/2.

Further, the left side of the window 100 contains a flat region 130 preceded by a tapered region 140. The purpose of the tapered region 140 is to provide a good spectral resolution when the transform is computed and to smooth the transition during overlap-and-add operations between adjacent blocks. Increasing the duration of the flat region 130 of the window reduces the information bandwidth and decreases the spectral performance of the window because a part of the window is sent without any information.

In the multi-mode Moving Pictures Expert Group (MPEG) Unified Speech and Audio Codec (USAC) audio codec, several special windows such as the one described in FIG. 1 are used to manage the different transitions from frames using rectangular, non-overlapping windows to frames using non-rectangular, overlapping windows. These special windows were designed to achieve different compromises between spectral resolution, data overhead reduction and smoothness of transition between these different frame types.

DETAILED DESCRIPTION

Figure 1:
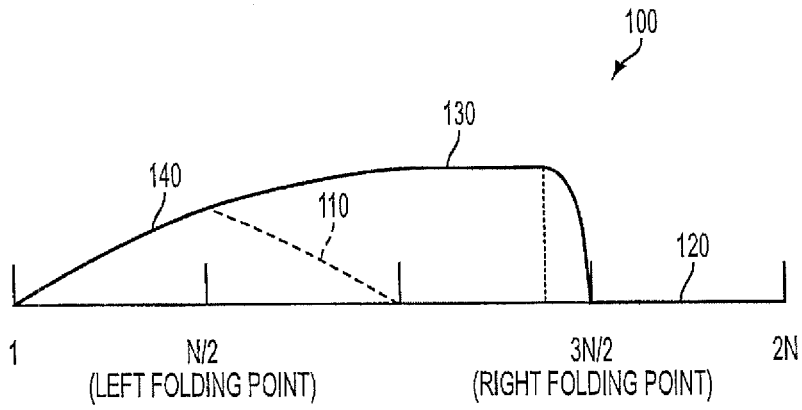
FIG. 1 is a diagram of an example of window introducing TDA on its left side but not on its right side.

According to a first non-restrictive illustrative aspect, there is provided a method for forward cancelling time-domain aliasing in a coded signal received in a bitstream at a decoder. The method comprises receiving in the bitstream at the decoder, from a coder, additional information related to correction of the time-domain aliasing in the coded signal. In the decoder, the time-domain aliasing is cancelled in the coded signal in response to the additional information.

According to a second non-restrictive illustrative aspect, there is provided a method for forward cancelling time-domain aliasing in a coded signal for transmission from a coder to a decoder. The method comprises calculating, in the coder, additional information related to correction of the time-domain aliasing in the coded signal. The additional information related to the correction of the time-domain aliasing in the coded signal is sent in a bitstream, from the coder to the decoder.

According to a third non-restrictive illustrative aspect, there is provided a device for forward cancelling time-domain aliasing in a coded signal received in a bitstream. The device comprises a receiver, from the bitstream from a coder, of additional information related to correction of the time-domain aliasing in the coded signal. The device also comprises a canceller of the time-domain aliasing in the coded signal in response to the additional information.

According to a fourth non-restrictive illustrative aspect, there is provided a device for forward time-domain aliasing cancellation in a coded signal for transmission to a decoder. The device comprises a calculator of additional information related to correction of the time-domain aliasing in the coded signal. The device also comprises a transmitter, in the bitstream, of the additional information related to the correction of the time-domain aliasing in the coded signal, to a decoder.

The foregoing and other features will become more apparent upon reading of the following non-restrictive description of illustrative embodiments thereof, given by way of example only with reference to the accompanying drawings.

More specifically, the following non-restrictive description addresses the problem of cancelling the effects of time-domain aliasing and non-rectangular windowing when an audio signal is encoded using both overlapping and non-overlapping windows in contiguous frames. Using the technology described herein the use of the special, non-optimal windows may be avoided while still allowing proper management of frame transitions in a model using both rectangular, non-overlapping windows and non-rectangular, overlapping windows.

An example of a frame using rectangular, non-overlapping windowing is Linear Predictive (LP) coding, and in particular ACELP coding. Alternatively, an example of non-rectangular, overlapping windowing is Transform Coded eXcitation (TCX) coding as applied in the MPEG Unified Speech and Audio Codec (USAC) where TCX frames use both overlapping windows and Modified Discrete Cosine Transform (MDCT), which introduces Time Domain Aliasing (TDA). USAC is also a typical example where contiguous frames can be encoded using either rectangular, non-overlapping windows such as in ACELP frames, or non-rectangular, overlapping windows, such as in TCX frames and in Advanced Audio Coding (AAC) frames. Without loss of generality, the present disclosure thus considers the specific example of USAC to illustrate the benefits of the proposed system and method.

Two distinct cases are addressed. The first case happens when the transition is from a frame using a rectangular, non-overlapping window to a frame using a non-rectangular, overlapping window. The second case happens when the transition is from a frame using a non-rectangular, overlapping window to a frame using a rectangular, non-overlapping window. For the purpose of illustration and without suggesting limitation, frames using a rectangular, non-overlapping window may be encoded using the ACELP model, and frames using a non-rectangular, overlapping window may be encoded using the TCX model. Further, specific durations are used for some frames, for example 20 milliseconds for a TCX frame, noted TCX20. However, it should be kept in mind that these specific examples are used only for illustration purposes, but that other frame lengths and coding types, other than ACELP and TCX, can be contemplated.

Figure 2:
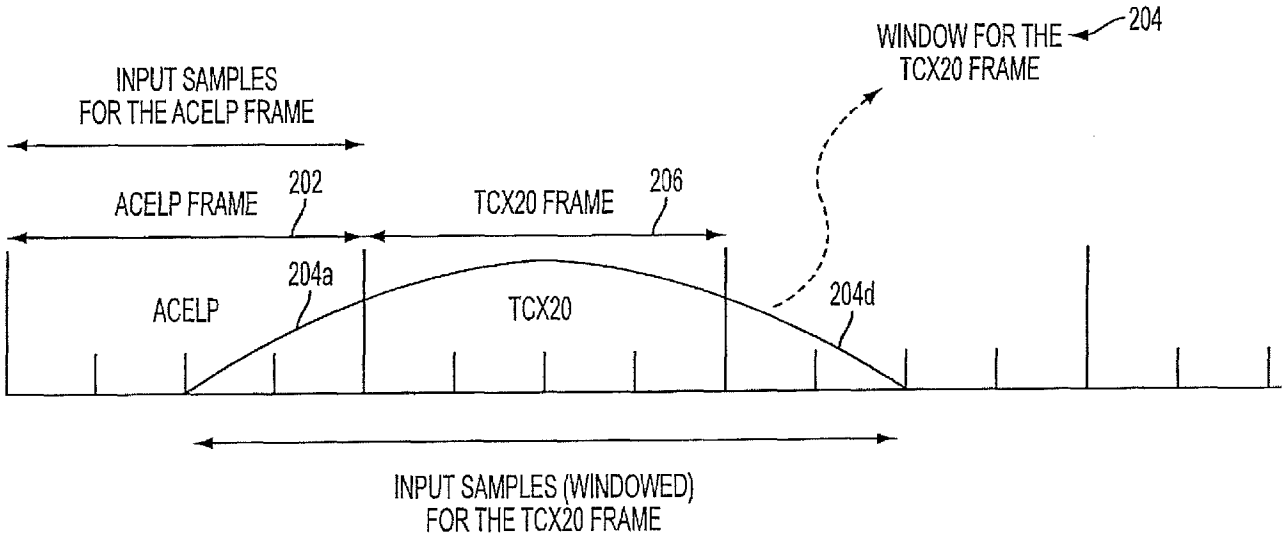
FIG. 2 is a diagram of an example of transition from a block using a non-overlapping rectangular window to a block using an overlapping window.

The case of a transition from a frame with rectangular, non-overlapping window to a frame with non-rectangular, overlapping window will now be addressed in relation to the following description taken in conjunction with FIG. 2, which is a diagram of an exemplary transition from a block using a non-overlapping rectangular window to a block using an overlapping window.

Referring to FIG. 2, an exemplary rectangular, non-overlapping window comprises an ACELP frame 202 and an exemplary a non-rectangular, overlapping window 204 comprises a TCX20 frame 206. TCX20 refers to the short TCX frames in USAC, which nominally have 20 ms in duration, as do the ACELP frames in many applications. FIG. 2 shows which samples are used in each frame, and how they are windowed at a coder. The same window 204 is applied at a decoder, such that the combined effect seen at the decoder is the square of the window shape shown in FIG. 2. Of course, this double windowing, once at the coder and a second time at the decoder, is typical in transform coding. When no window is drawn, as in the ACELP frame 202, this actually means that a rectangular window is used for that frame. The non-rectangular window 204 for the TCX20 frame 206 shown in FIG. 2 is chosen such that, if the previous and next frames also use overlapping and non-rectangular windows, then the overlapping portions 204*a* and 204*b* of the windows are, after the second windowing at the decoder, complementary and allow recovering the "non windowed" signal in the overlapping region of the windows.

Figure 3:
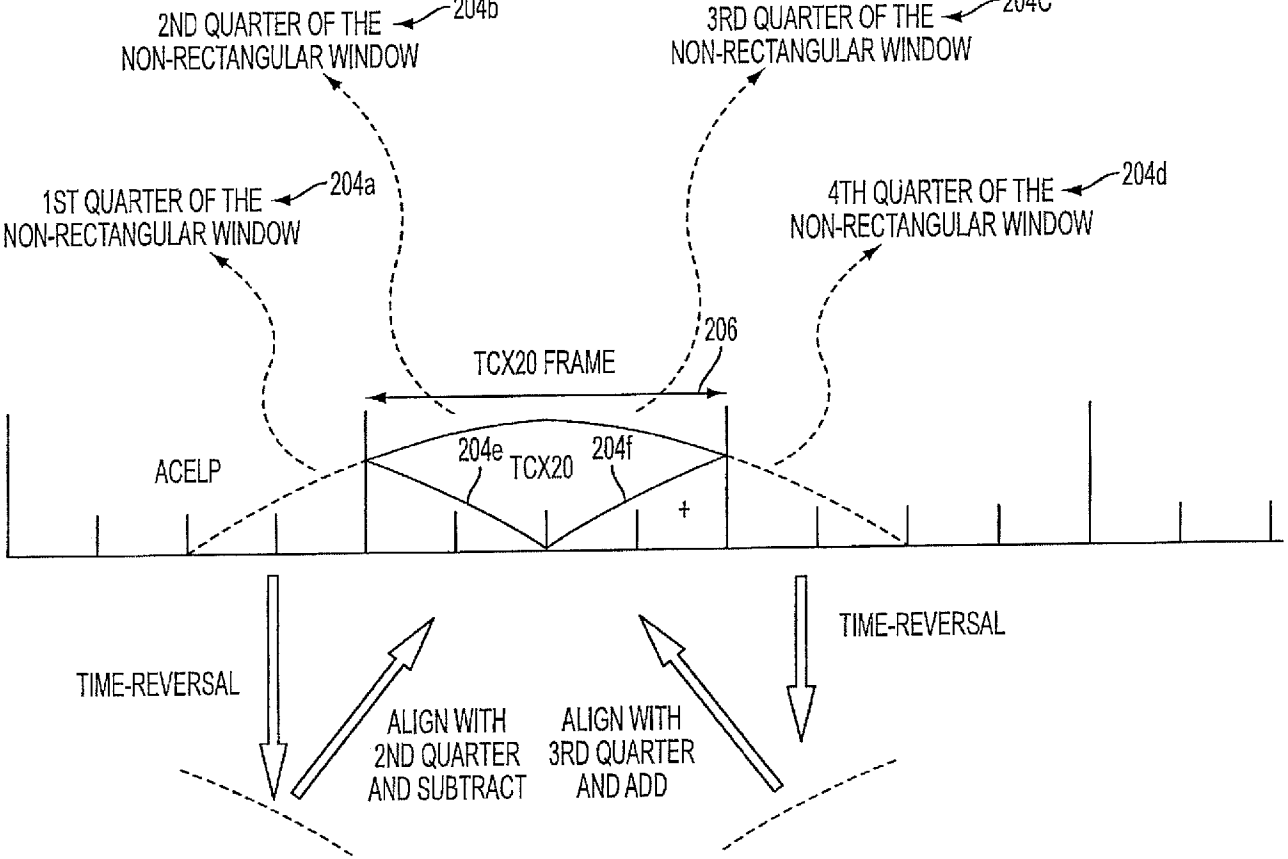
FIG. 3 is a diagram showing folding and TDA applied to the diagram of FIG. 2.

To encode the TCX20 frame 206 of FIG. 2 in an efficient manner, time-domain aliasing (TDA) is typically applied to the windowed samples for that TCX20 frame 206. Specifically, the left 204*a* and right 204*d* portions of the window 204 are folded and combined. FIG. 3 is a diagram showing folding and TDA applied to the diagram of FIG. 2. The non-rectangular window 204 introduced in the description of FIG. 2 is shown in four quarters. The $1^{st}$ and $4^{th}$ quarters, 204*a* and 204*d* of the window 204 are shown in dotted line as they are combined with the $2^{nd}$ and $3^{rd}$ quarters 204*b*, 204*c*, shown in solid line. Combining the $1^{st}$ and $4^{th}$ quarters 204*a*, 204*d*, to the $2^{nd}$ and $3^{rd}$ quarters 204*b*, 204*c*, is done, in a process similar to the one used in MDCT encoding, as follows. The $1^{st}$ quarter 204*a* is time-reversed, then it is aligned, sample-by-sample, to the $2^{nd}$ quarter 204*b* of the window, and finally the time-reversed and shifted $1^{st}$ quarter 204*e* is subtracted from the $2^{nd}$ quarter 204*b* of the window. Similarly, the $4^{th}$ quarter 204*d* of the window is time-reversed and shifted (204*f*) to be aligned with the $3^{rd}$ quarter 204*c* of the window, and is finally added to the $3^{rd}$ quarter 204*c* of the window. If the TCX20 window 204 shown in FIG. 2 has 2N samples, then at the end of this process we obtain N samples extending exactly from the beginning to the end of the TCX20 frame 206 of FIG. 3. Then these N samples form the input of an appropriate transform for efficient encoding in the transform domain. Using the specific time-domain aliasing described in FIG. 3, the MDCT can be the transform used for this purpose.

After the combination of time-reversed and shifted portions of the window described in FIG. 3, it is no longer possible to recover the original time-domain samples in the TCX20 frame because they are mixed with time-reversed versions of samples outside the TCX20 frame. In an MDCT-based audio coder such as MPEG AAC, where all frames are encoded using the same transform and overlapping windows, this time-domain aliasing can be cancelled, and the audio samples can be recovered by using two consecutive overlapped frames. However, when contiguous frames do not use the same windowing and overlapping process, as in FIG. 2 where the TCX20 frame is preceded by an ACELP frame, the effect of the non-rectangular window and time-domain aliasing cannot be eliminated using only the information from the previous ACELP frame and next TCX20 frame.

Techniques to manage this type of transition were presented hereinabove. The present disclosure proposes an alternative approach to managing these transitions. This approach does not use non-optimal and asymmetric windows in the frames where MDCT-based transform-domain coding is used. Instead, the methods and devices introduced herein allow the use of symmetric windows, centered at the middle of the encoded frame, such as for example the TCX20 frame of FIG. 3, and with 50% overlap with MDCT-coded frames also using non-rectangular windows. The methods and devices introduced herein thus propose to send from the coder to the decoder, as additional information in the bitstream, the correction to cancel the windowing effect and the time-domain aliasing when switching from frames coded with a rectangular, non-overlapping window and frames coded with a non-rectangular, overlapping window, and vice-versa. Several cases are possible in these transitions.

In FIG. 2, rectangular, non-overlapping windowing is shown for the ACELP frame, and non-rectangular, overlapping windowing is shown for the TCX20 frame. Using the TDA introduced in FIG. 3, a decoder receiving at first, the bits from the ACELP frame has sufficient information to completely decode this ACELP frame up to its last sample. But then, receiving the bits from the TCX20 frame, properly decoding all the samples in the TCX20 frame is impaired by the aliasing effect caused by the presence of the preceding ACELP frame. If a next frame also uses an overlapping window, then the non-rectangular windowing and TDA introduced at the coder can be cancelled in the second half of the shown TCX20 frame and theses samples can be decoded properly. It is thus in the first half of the TCX20 frame, where the time-reversed and shifted $1^{st}$ quarter 204*e* is subtracted from 204*b* in FIG. 3 that the effect of the non-rectangular window and the TDA introduced at the coder cannot be cancelled since the previous ACELP frame uses a non-overlapping window. Hence, the methods and devices introduced herein propose to transmit the information, Forward time-domain Aliasing Cancellation (FAC), for cancelling these effects, and properly recover the first half of the TCX20 frame.

Figure 4:
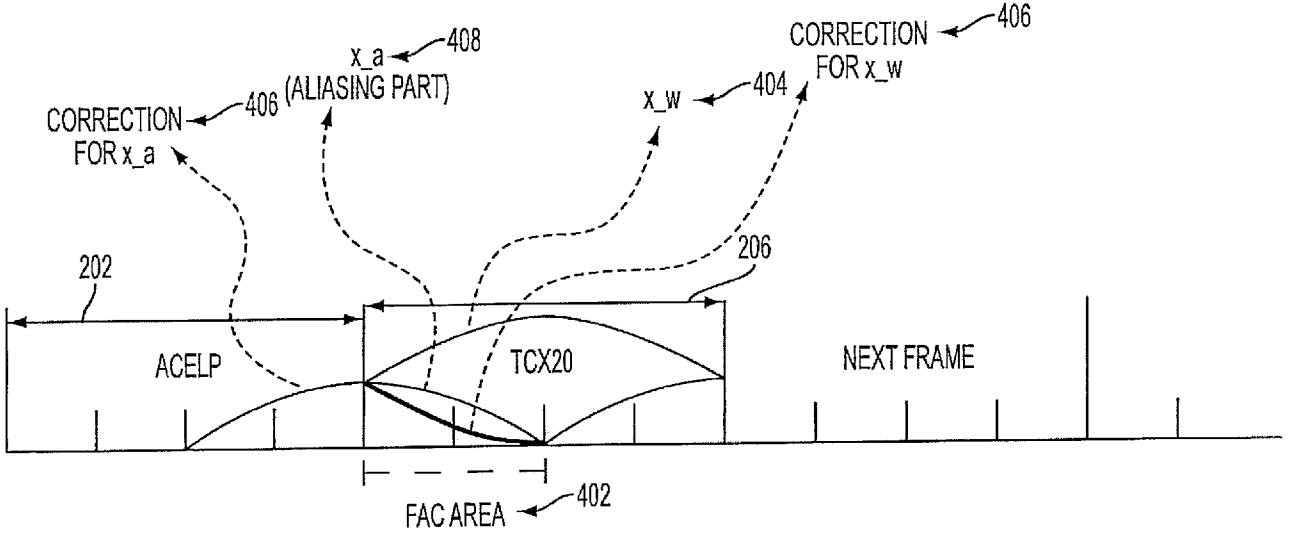
FIG. 4 is a diagram showing forward aliasing correction applied to the diagram of FIG. 2.

FIG. 4 is a diagram showing forward aliasing correction (FAC) applied to the diagram of FIG. 2. FIG. 4 illustrates the situation at the decoder, where the windowing, for example a cosine window applied by MDCT, has already been applied a second time after the inverse transform. Only the ACELP to TCX20 transition is considered, independently of the frame following the TCX20 frame. Hence, in FIG. 4, the samples where the FAC correction is applied correspond to the first half of the TCX20 frame. This is what is referred to as the FAC area 402. There are two effects that are compensated for by the FAC in this example. The first effect is the windowing effect, referred to as x_w 404 in FIG. 4. This corresponds to the product of the samples in the first half of the TCX20 frame 206 by the $2^{nd}$ quarter 204*b* of the non-rectangular window in FIG. 3. Thus, the first part of the FAC correction comprises adding the complement of these windowed samples, which corresponds to the correction for x_w 406 segment in FIG. 4. For example, if a given input sample x[n] was multiplied by window sample w[n] at the coder, then the complement of this windowed sample is simply ((1−w[n]) times x[n]). The sum of x_w 404 and the correction for x_w 406 is 1 for all samples in this segment. The second part of the FAC correction corresponds to the time-domain aliasing component that was added at the coder in the TCX20 frame. To eliminate this aliasing component, named aliasing part x_a 408 in FIG. 4, the correction for x_a 406 in FIG. 4 is time-inverted, aligned to the first half of the TCX20 frame and added to this first half of the segment, shown as an x_a aliasing part 408. The reason why it is added, and not subtracted, is that in FIG. 3, the left part of the folding leading to time-domain aliasing involved subtracting this component, so to eliminate it is now added back. The sum of these two parts, the window compensation x_w 404 and the aliasing compensation x_a 408, which forms the complete FAC correction in the FAC area 402.

Figure 5:
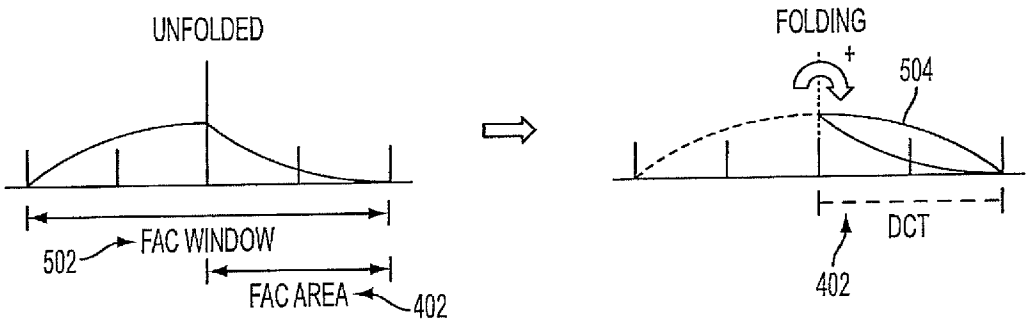
FIG. 5 is a diagram showing an unfolded FAC correction (left) and a folded FAC correction (right)

There are several options for encoding the FAC correction. FIG. 5 is a diagram showing an unfolded FAC correction (left) and a folded FAC correction (right). One option may be to directly encode the FAC windowed signal, as shown on the left-hand side of FIG. 5. This signal, referred to as the FAC window 502 in FIG. 5, covers twice the length of the FAC area. At the decoder, the decoded FAC windowed signal may then be folded (time-inverting the left half and adding it to the right half) and then this folded signal may be added, as a correction 504, in the FAC area 402, as shown at the right-hand side of FIG. 5. In this approach, twice the time-domain samples are encoded compared to the length of the correction.

Another approach for encoding the FAC correction signal shown at the left of FIG. 5 is to perform the folding at the coder prior to encoding this signal. This results in the folded signal at the right of FIG. 5, where the left half of the FAC windowed signal is time-reversed and added to the right half of the FAC windowed signal. Then, transform coding, using for example DCT, can be applied to this folded signal. At the decoder, the decoded folded signal can be simply added in the FAC area, since the folding has already been applied at the coder. This approach allows encoding the same number or time-domain samples as the length of the FAC area, resulting in critically-sampled transform coding.

Figure 6:
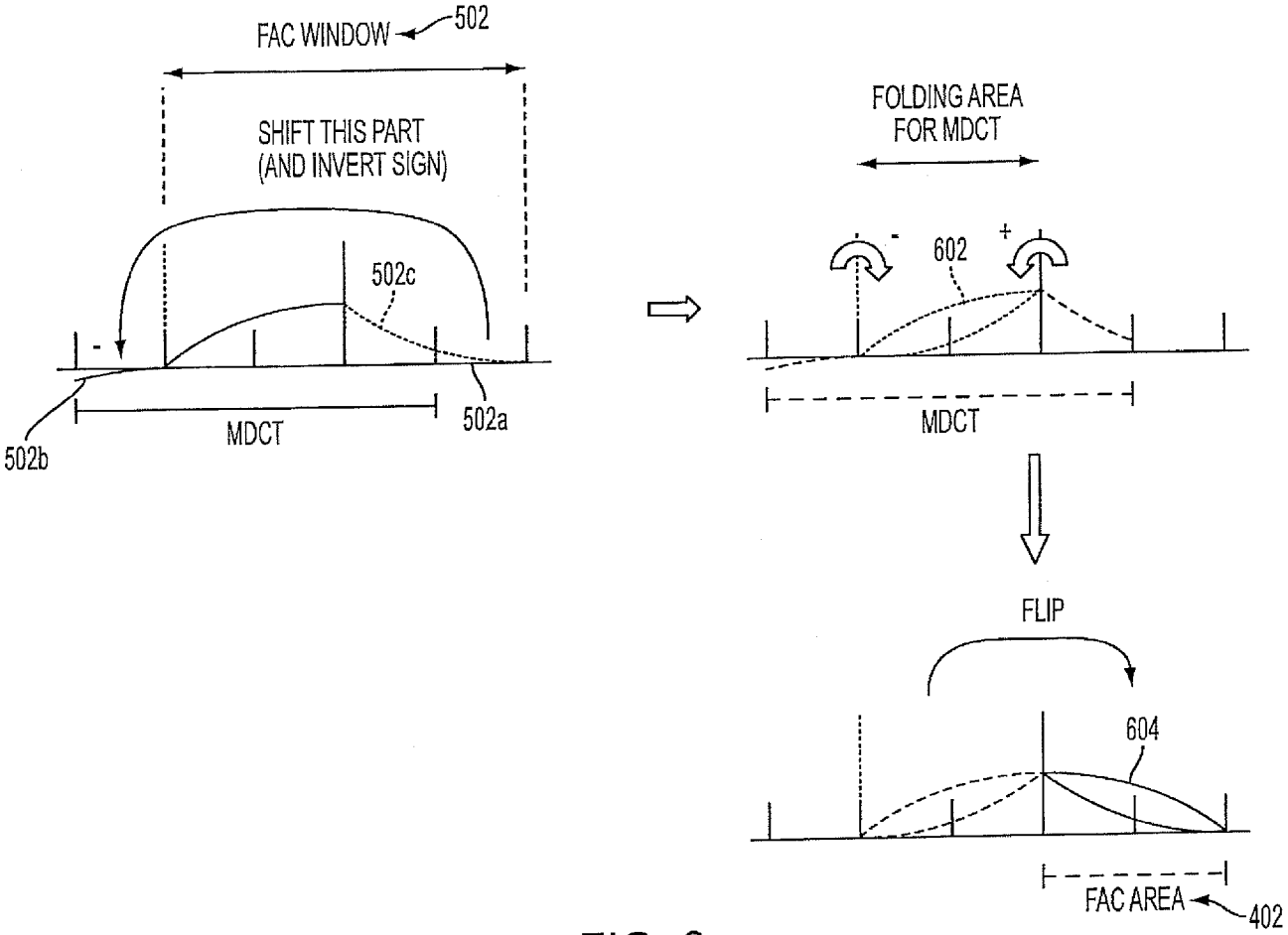
FIG. 6 is an illustration of a first application of a method of FAC correction using MDCT.

Yet another approach to encode the FAC correction signal shown at the left of FIG. 5 is to use the implicit folding of the MDCT. FIG. 6 is an illustration of a first application of a method of FAC correction using MDCT. In the upper left quadrant, a content of the FAC window 502 is shown, with a slight modification. Specifically, the last quarter of the FAC window 502*a* is shifted to the left of the FAC window 502 and inverted in sign (502*b*). In other words, the FAC window of FIG. 5 is cyclically rotated to the right by ¼ of its total length, and then the sign of the first ¼ of the samples is inverted. An MDCT is then applied to this windowed signal. The MDCT applies, implicitly by its mathematical construction, a folding operation, which results in the folded signal 602 shown at the upper right quadrant of FIG. 6. This folding in the MDCT applies a sign inversion on the left part 502*b*, but not on the right part 502*c*, where the folded segment is added. Comparing the resulting folded signal 602 to the complete FAC correction 504 of FIG. 5, it can be seen that it is equivalent to the FAC correction 504 except for time inversion. Thus, at the decoder, after inverse MDCT (IMDCT), this signal 602, which is an inverted FAC correction signal, is inverted in time (or flipped) and becomes a FAC correction signal 604 as shown at the bottom right quadrant of FIG. 6. As above, this FAC correction 604 can be added to the signal in the FAC area of FIG. 4.

Figure 7:
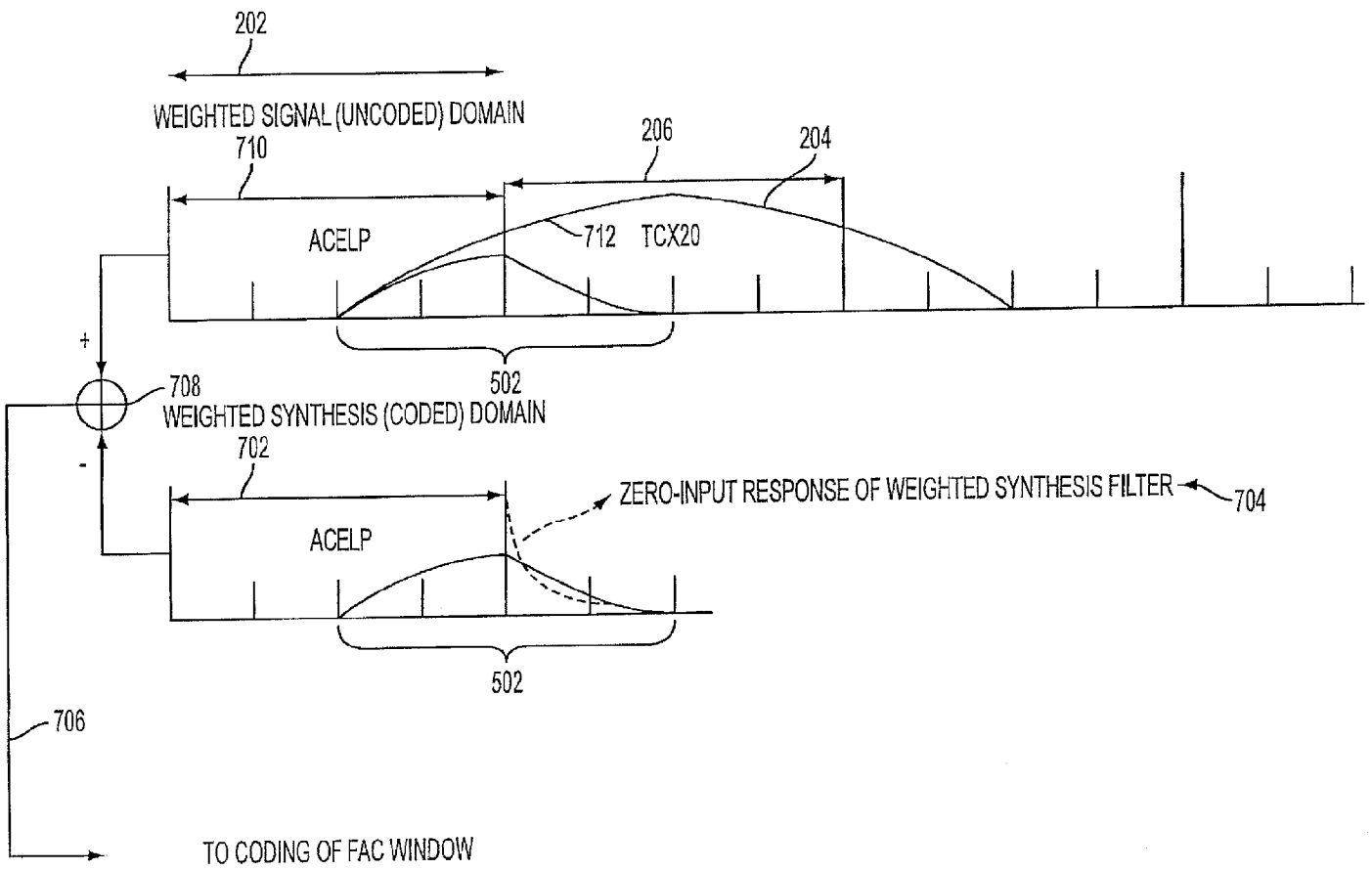
FIG. 7 is a diagram of a FAC correction using information from ACELP mode.

In the specific case of a transition from an ACELP frame to a TCX frame, further efficiency can be achieved by taking advantage of information already available at the decoder. FIG. 7 is a diagram of a FAC correction using information from the ACELP mode. An ACELP synthesis signal 702 up to the end of the ACELP frame 202 is known at the decoder. Further, a zero-input response (ZIR) 704 of a synthesis filter has good correlation with the signal at the beginning of the TCX20 frame 206. This particularity is already used in the 3GPP AMR-WB+ standard to manage transitions from ACELP to TCX frames. Here, this information is used for two purposes: 1) to reduce the signal amplitude to be encoded as the FAC correction and 2) to ensure continuity in the error signal so as to enhance the efficiency of MDCT coding of this error signal. Looking at FIG. 7, a correction signal 706 to be encoded for transmission of the FAC correction is computed as follows. The first half of this correction signal 706, that is up to the end of the ACELP frame 202, is taken as the difference 708 between the weighted signal 710 in the original, uncoded domain, and the weighted synthesis signal 702 in the ACELP frame 202. Given the ACELP coding module has sufficient performance, this first half of the correction signal 706 has reduced energy and amplitude compared to the original signal. Then, for a second half of said correction signal 706, the difference 708 is taken between the weighted signal 712 in the original, uncoded domain at the beginning of the TCX20 frame 206 and the zero-input response 704 of the ACELP weighted synthesis filter. Since the zero-input response 704 is correlated to the weighted signal 712, at least to some extent especially at the beginning of the TCX20 frame, this difference has lower amplitude and energy compared to the weighted signal 712 at the beginning of the TCX20 frame. This efficiency of the zero-input response 704 in modeling the original signal is typically greater at the beginning of the frame. Adding the effect of the FAC window 502, which has a decreasing amplitude for this second half of the FAC window, the shape of the second half of the correction signal 706 in FIG. 7 should tend towards zero at the beginning and the end, with possibly more energy concentrated in the middle of the second half of the FAC window 502, depending on the accuracy of fit of the ZIR to the weighted signal. After performing these windowing and difference operations as described in relation to FIG. 7, the resulting correction signal 706 can be encoded as described in FIG. 5 or 6, or by any selected method to encode the FAC signal. At the decoder, the actual FAC correction signal is re-computed by first decoding the transmitted correction signal 706 described above, and then adding back the ACELP synthesis signal 702 to signal 706, in the first half of the FAC window 502 and adding the ZIR 704 to the same signal 706, in the second half of the FAC window 502.

Figure 8:
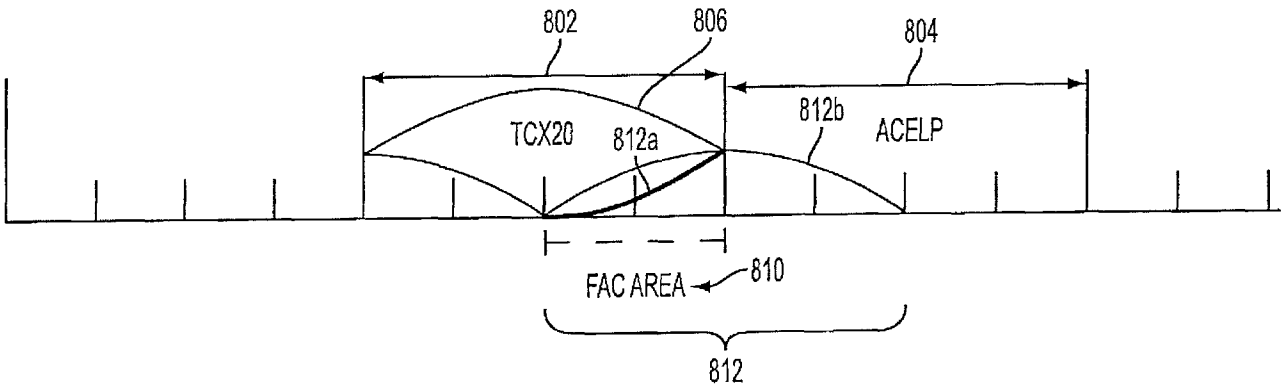
FIG. 8 is a diagram of a FAC correction applied upon transition from a block using an overlapping window to a block using a non-overlapping rectangular window.

Up to this point, the present disclosure has described transitions from a frame using a rectangular, non-overlapping window, to a frame using a non-rectangular, overlapping window, using as an example the case of a transition from an ACELP frame to a TCX frame. It is understood that the opposite situation can arise, namely a transition from a TCX frame to an ACELP frame. FIG. 8 is a diagram of a FAC correction applied upon transition from a frame using an overlapping non-rectangular window to a frame using a non-overlapping rectangular window. FIG. 8 shows a TCX20 frame 802 followed by an ACELP frame 804, with a folded TCX20 window 806, as seen at the decoder, in the TCX frame. FIG. 8 also shows a FAC area 810 where a FAC correction is applied to cancel the windowing effect and the time-domain aliasing at the end of the TCX20 frame 802. It is to be noted that the ACELP frame 804 does not carry the information to cancel these effects. A FAC window 812 is the symmetrical of the FAC window 502 of FIG. 5.

Folding of the two parts 812-left and 812-right of the FAC window 812 is thus shown in the case of a transition from a TCX frame to an ACELP frame. Comparing to FIG. 5, the differences are the following: the FAC window 812 is now time-reversed and the folding of the aliasing part applies a subtraction operation, instead of an addition as illustrated in FIG. 5, in order to be coherent with the folding sign of the MDCT in that portion of the window.

Figure 9:
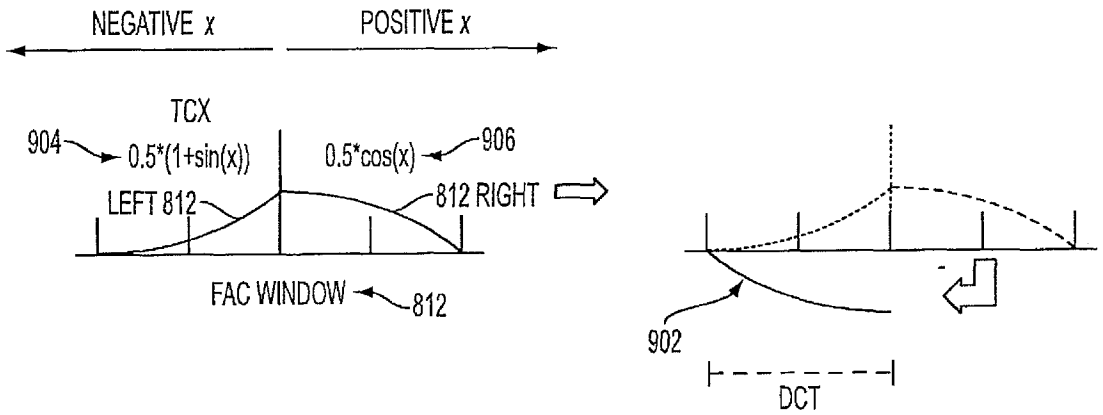
FIG. 9 is a diagram of an unfolded FAC correction (left) and folded FAC correction (right)

FIG. 9 is a diagram of an unfolded FAC correction (left) and folded FAC correction (right). The FAC window 812 is reproduced at the left-hand side of FIG. 9. The folded FAC correction signal 902 may be encoded using a DCT or some other applicable method. Assuming a Hanning window in the transform, as used for example in MDCT, equations 904 and 906 of FIG. 9 describe the FAC window 812 in the case of FIG. 9. Of course, when other window shapes are used, other equations coherent with the window shapes are used to describe the FAC window. Also, using a Hanning-type window in the MDCT means that a cosine window is used at the coder, prior to MDCT and, again, a cosine window is used at the decoder, after IMDCT. It is the sample-by-sample combination of these two cosine windows that results in the desired Hanning window shape which has the appropriate complementary shape for overlap-and-add in the 50% overlap portion of the window.

Figure 10:
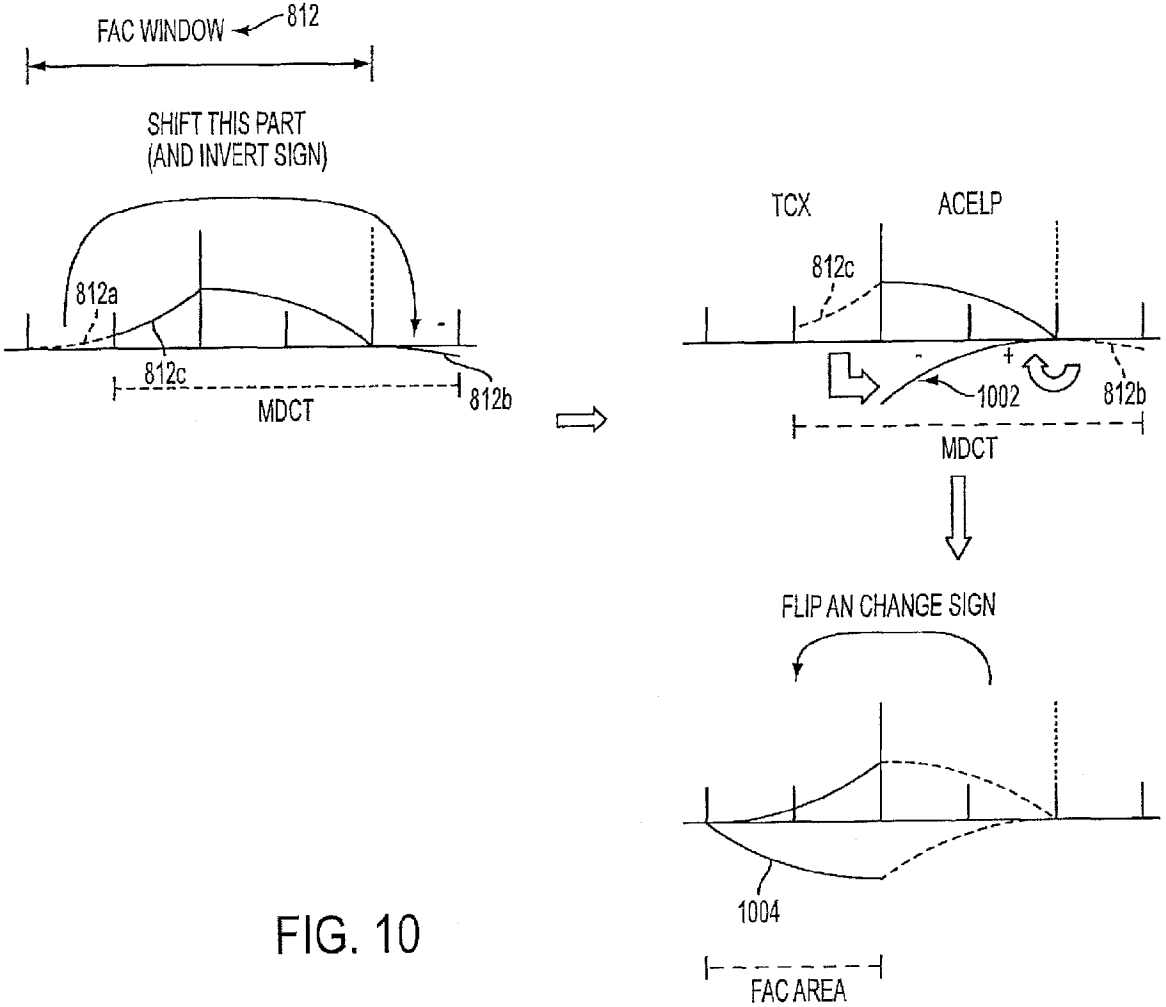
FIG. 10 is an illustration of a second application of the method of FAC correction using MDCT.

Again, an MDCT approach can also be used to encode the FAC window, as was described in FIG. 6. FIG. 10 is an illustration of a second application of the method of FAC correction using MDCT. In the upper left quadrant of FIG. 10, the FAC window 812 of FIG. 8 is shown. The first quarter 812*a* of the FAC window 812 is shifted to the right of the FAC window and inverted in sign (812*b*). In other words, the FAC window 812 is cyclically rotated to the left by ¼ of its total length, and then the sign of the last ¼ of the samples is inverted. In the upper right quadrant of FIG. 10, an MDCT is then applied to this windowed signal. The MDCT applies, internally, a folding operation, which results in the folded signal 1002 shown at the upper right quadrant of FIG. 10. This folding in the MDCT applies a sign inversion on the left part 812*c*, and not on the right part 812*b*, where the folded segment is added. Comparing the resulting folded signal 1002 to the FAC correction signal 902 at the right-hand side of FIG. 9, it can be seen that it is equivalent except for time inversion (flipping) and sign inversion. Thus, at the decoder, after IMDCT, this signal 1002, which is an inverted FAC correction, is inverted in time (or flipped) and inverted in sign and becomes a FAC correction 1004 as shown at the bottom right quadrant of FIG. 10. As above, this FAC correction 1004 can be added to the signal in the FAC area of FIG. 8.

Quantizing the signal corresponding to the FAC correction involves proper care. Indeed, the FAC correction is a part of the transform-domain encoded signal, including for example, the TCX20 frames used in the examples of FIGS. 2 to 10, since it is added to the frame to compensate the windowing and aliasing effects. Since quantization of this FAC correction introduces distortion, this distortion is controlled in such as way that it blends properly in, or matches the distortion of, the transform-domain encoded frame, and does not introduce audible artifacts in this transition corresponding to the FAC area. If the noise level due to quantization, as well as the quantization noise shape in the time and frequency domain, are maintained approximately the same in the FAC correction signal as in the transform-based encoded frame where the FAC correction is applied, then the FAC correction does not introduce additional distortion.

There are several approaches possible to quantize the FAC correction signal, including but not limited to scalar quantization, vector quantization, stochastic codebooks, algebraic codebooks, and the like. In every case, it can be understood that there is a strong correlation in the attributes of the coefficients of the FAC correction and the coefficients of the corresponding transform-domain coded frame, as in the exemplary TCX 20 frame. Indeed, the time-domain samples used in the FAC area should be the same time-domain samples at the beginning of the transform-domain coded frame. Thus, the scale factors used in the quantization device applied to the transform-domain coded frame are approximately the same as the scale factors used in the quantization device applied to FAC correction. Of course, the number of samples, or frequency-domain coefficients, in the FAC correction is not the same as in the transform-domain coded frame: the transform-domain coded frame has more samples than the FAC correction, which covers only a part of the transform-domain coded frame. What is important is to maintain the same level of quantization noise, per frequency-domain coefficient, in the FAC correction signal as in the corresponding transform-domain coded frame (for example a TCX 20 frame).

Taking the specific example of the Algebraic Vector Quantization (AVQ) approach used in the 3GPP AMR-WB+ audio coding standard to quantize spectral coefficients, and applying it to the quantization of the FAC correction, the following observation can be drawn. The global gain of the AVQ calculated in the quantization of the transform-domain coded frame, for example a TCX20 frame, this global gain being used to scale the amplitudes of the frequency-domain coefficients to keep the bit consumption below a specific bit budget, can be a reference gain for the one used in the quantization of the FAC frame. This applies also to any other scale factors, for example the scale factors used in the Adaptive Low-Frequency Enhancer (ALFE) such as the one used in the AMR-WB+ standard. Yet other examples include the scale factors in AAC encoding. Any other scale factors which control the noise level and shape in the spectrum are also considered in this category.

Depending on the length of the transform-domain coded frame, an m-to-1 mapping of these scale factor parameters are applied between the transform-domain coded frame and the FAC correction. For example, in the case where three 20 ms, 40 ms or 80 ms TCX frame lengths are used, as in the MPEG USAC audio codec, the scale factors, such as for example the scale factors used in ALFE, used for m consecutive spectral-domain coefficients in the transform-domain coded frame may be used for 1 spectral-domain coefficient in the FAC correction.

Figure 11:
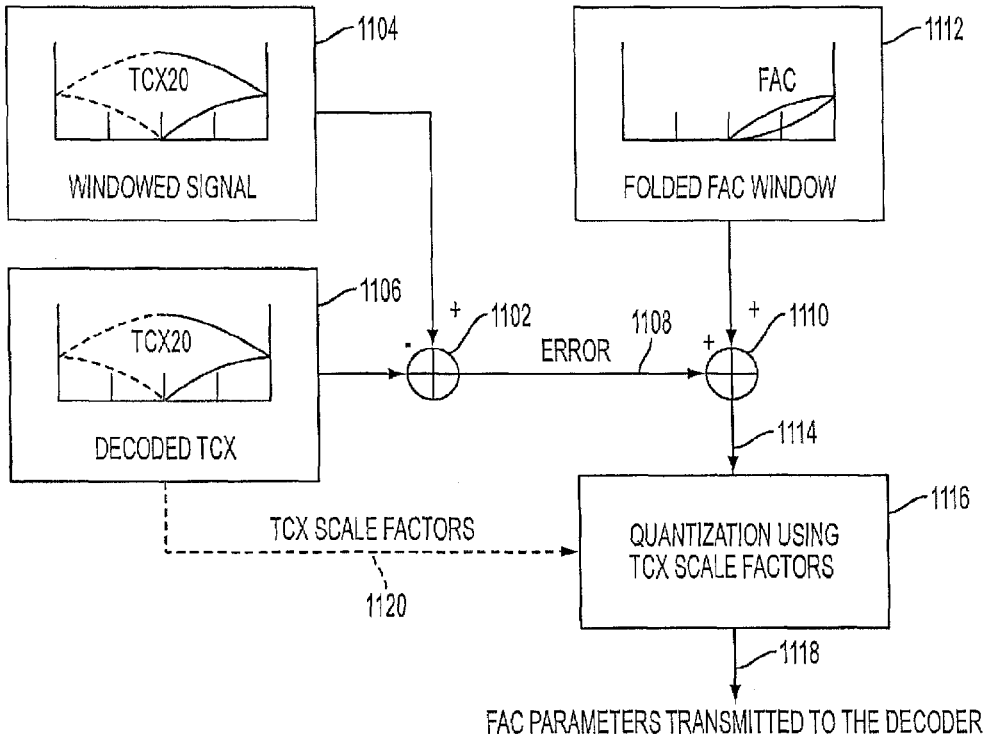
FIG. 11 is a block diagram of FAC quantization including TCX error correction.

To match the quantization error level of the FAC correction to the quantization error level of the transform-based encoded frame, it is appropriate to take into account, at the coder, the coding error of the windowed transform-based encoded frame. FIG. 11 is a block diagram of FAC quantization including TCX error correction. First, a difference 1102 is calculated between the windowed and folded signal in the TCX frame 1104 and the windowed and folded TCX synthesis of that frame 1106. The TCX synthesis 1106, in this context, is simply the inverse transform—including windowing applied at the decoder—of the quantized transform-domain coefficients of that TCX frame. Then, this difference signal 1108, or TCX coding error, is added at 1110 to the FAC correction signal 1112, synchronized with the FAC area. It is then this composite signal 1114, comprising the FAC correction 1112 signal plus coding error 1108 of the TCX frame, which is quantized by a quantizer 1116 for transmission to the decoder. As such, this quantized FAC correction signal 1118, as per FIG. 11, corrects, at the decoder, the windowing effect and aliasing effect, as well as the TCX coding error in the FAC area. Using the TCX scale factors 1120, as shown in FIG. 11, allows matching the distortion of the FAC correction to the distortion in the TCX frame.

Figure 12:
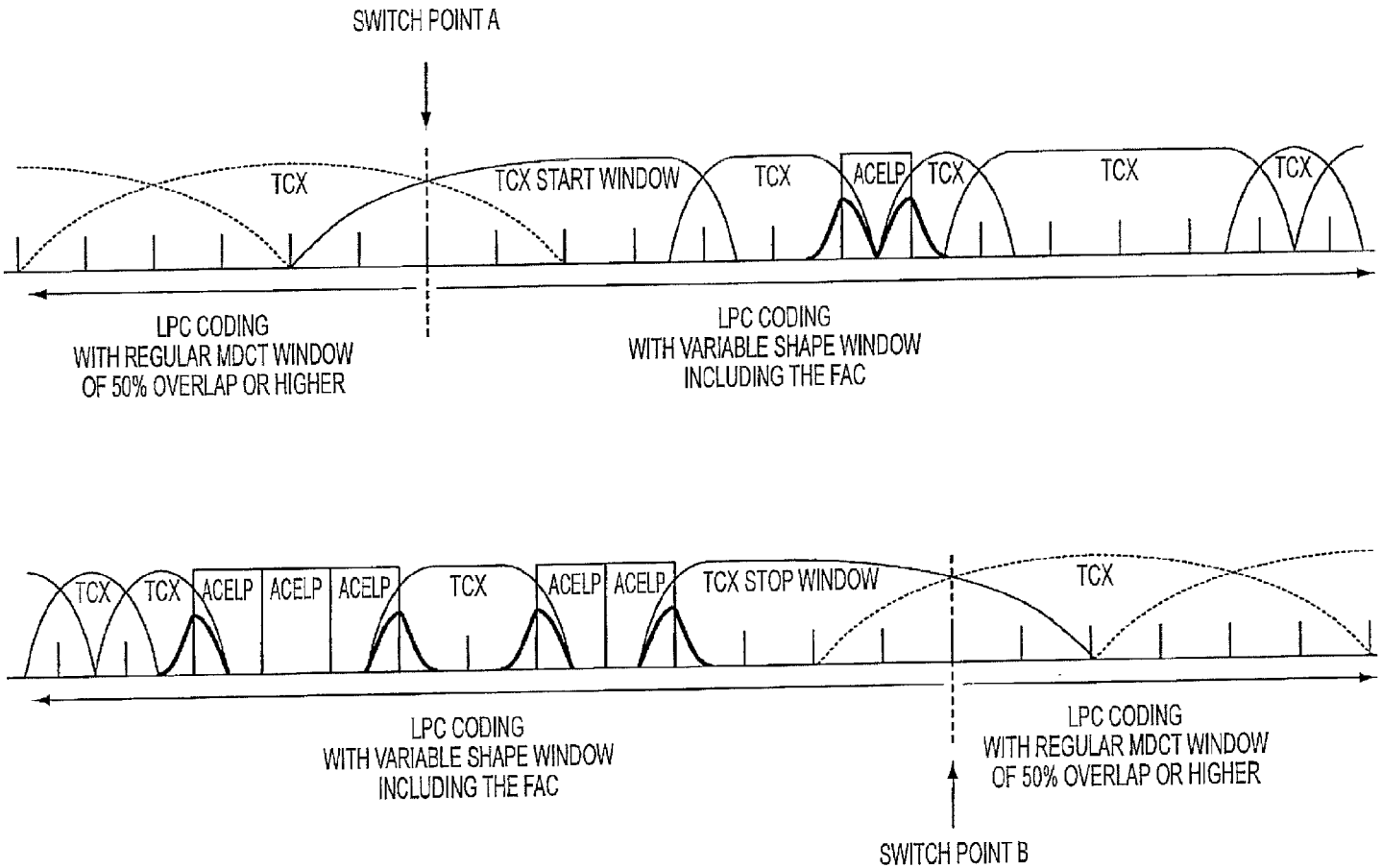
FIG. 12 is a diagram of various use cases of the FAC correction in a multi-mode coding system.

FIG. 12 is a diagram of a use case of the FAC correction in a multi-mode coding system. Examples are provided showing switching between regular shaped windows with 50% or more overlap and variable shaped windows, including the FAC windows. In FIG. 12, the lower part can be seen as a continuation of the upper part on the time axis. It is assumed in FIG. 12 that all frames are encoded after pre-processing the input audio signal through a time-varying filtering process, which can be, for example, a weighting filter derived from an LPC analysis on the input signal, or some other processing with the aim of weighting the input signal. In this example, the input signal is encoded, up to "switch point A", using an approach in the family of state-of-the-art audio coding such as AAC, where the analysis windows are optimized for frequency-domain coding. Typically, this means using windows with 50% overlap and regular shape as in the cosine window used in MDCT coding even though other window shapes can be used for this purpose. Then, between "Switch point A" and "Switch point B", the input signal is encoded using windows of variable length and shape, not necessarily optimized for transform-domain coding but rather designed to achieve some compromise between time and frequency resolution for the coding modes used in this segment. FIG. 12 shows the specific example of ACELP and TCX coding modes used in this segment. It can be seen that the window shapes, for these coding modes, are significantly heterogeneous and vary in shape and length. The ACELP window is rectangular and non-overlapping, while the window for TCX is non-rectangular and overlapping. This is where the FAC window is used to cancel the time-domain aliasing, as was described herein above. The FAC window itself, shown in bold in FIG. 12, with its specific shape and length, is one of the variable shape windows enclosed in the segment between "Switch point A" and "Switch point B".

Figure 13:
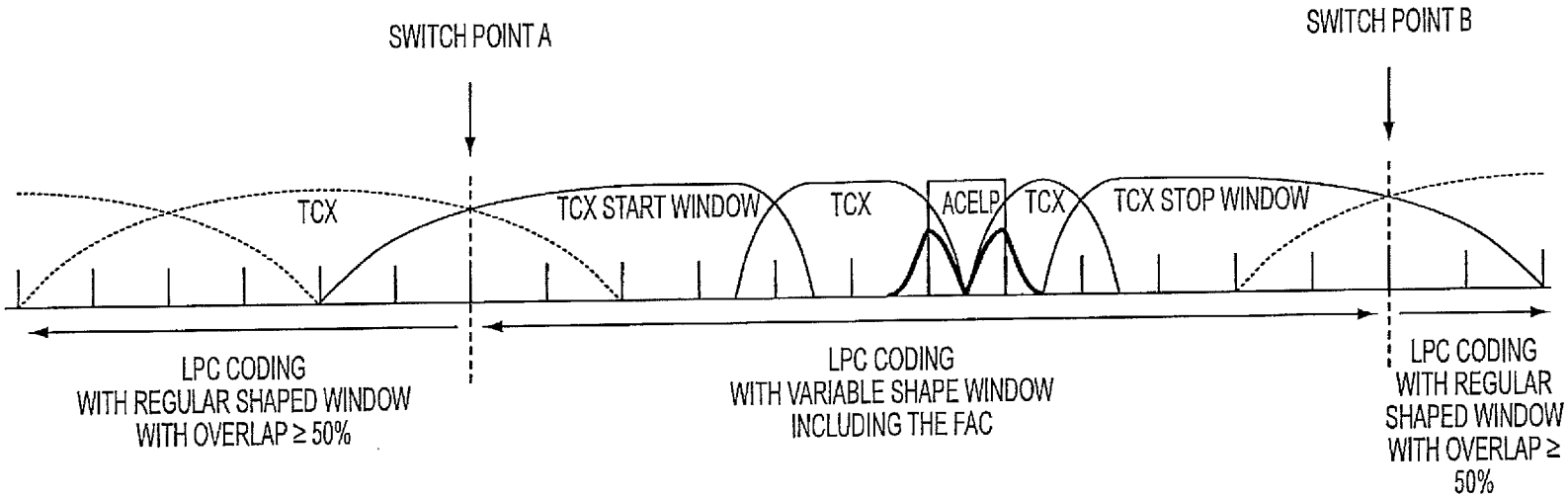
FIG. 13 is a diagram of another use case of the FAC correction in a multi-mode coding system.

FIG. 13 is a diagram of another use case of the FAC correction in a multi-mode coding system. FIG. 13 shows how the FAC window can be used in a context where a coder switches locally from regular shaped windows to variable-shape windows to encode a transient signal. This is similar to the context of AAC coding where a start- and stop-window is used to locally use windows with smaller time support for encoding transients. Here, instead, in FIG. 13, the signal between "Switch point A" and "Switch point B", assumed to be a transient, is encoded using multi-mode coding, involving ACELP and TCX in the presented example, which requires the use of the FAC window to properly manage the transition with the ACELP coding mode.

Figure 14:
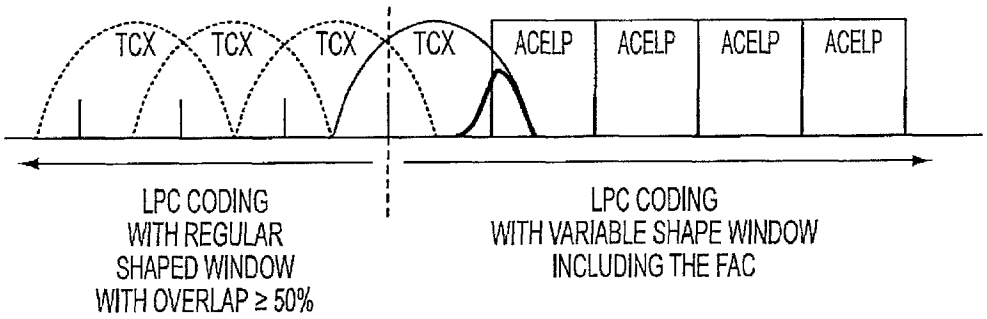
FIG. 14 is a diagram of a first use case of the FAC correction upon switching between short transform-based frames and ACELP frames.
Figure 15:
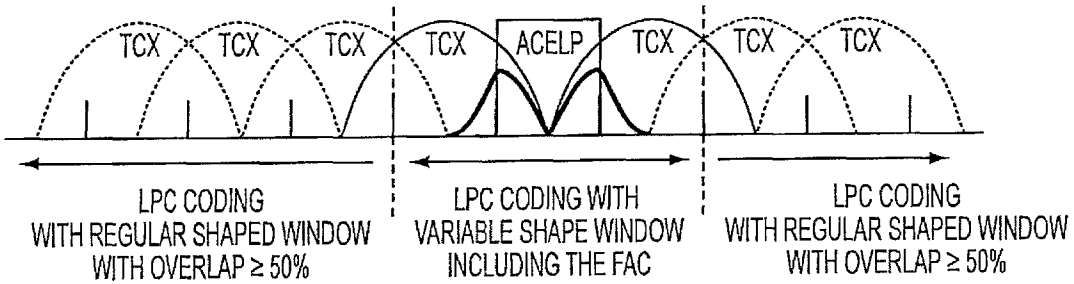
FIG. 15 is a diagram of a second use case of the FAC correction upon switching between short transform-based frames and ACELP frames.

FIGS. 14 and 15 are diagrams of first and second use cases of the FAC correction upon switching between short transform-based frames and ACELP frames. These are cases where switching is done between short transform-based frames in the LPC domain, for example, short TCX frames, and ACELP frames. The example of FIGS. 14 and 15 can be seen as a local situation in a longer signal which may also use other coding modes in other frames (not shown). It should be noted that the window for the short TCX frames in FIGS. 14 and 15 may have more than 50% overlap. For example, this may be the case in the Low-Delay AAC codec, which uses a long asymmetric window. In that case, some specific start- and stop-windows are designed to allow proper switching between these long asymmetric windows and the short TCX windows of FIGS. 14 and 15.

Figure 16:
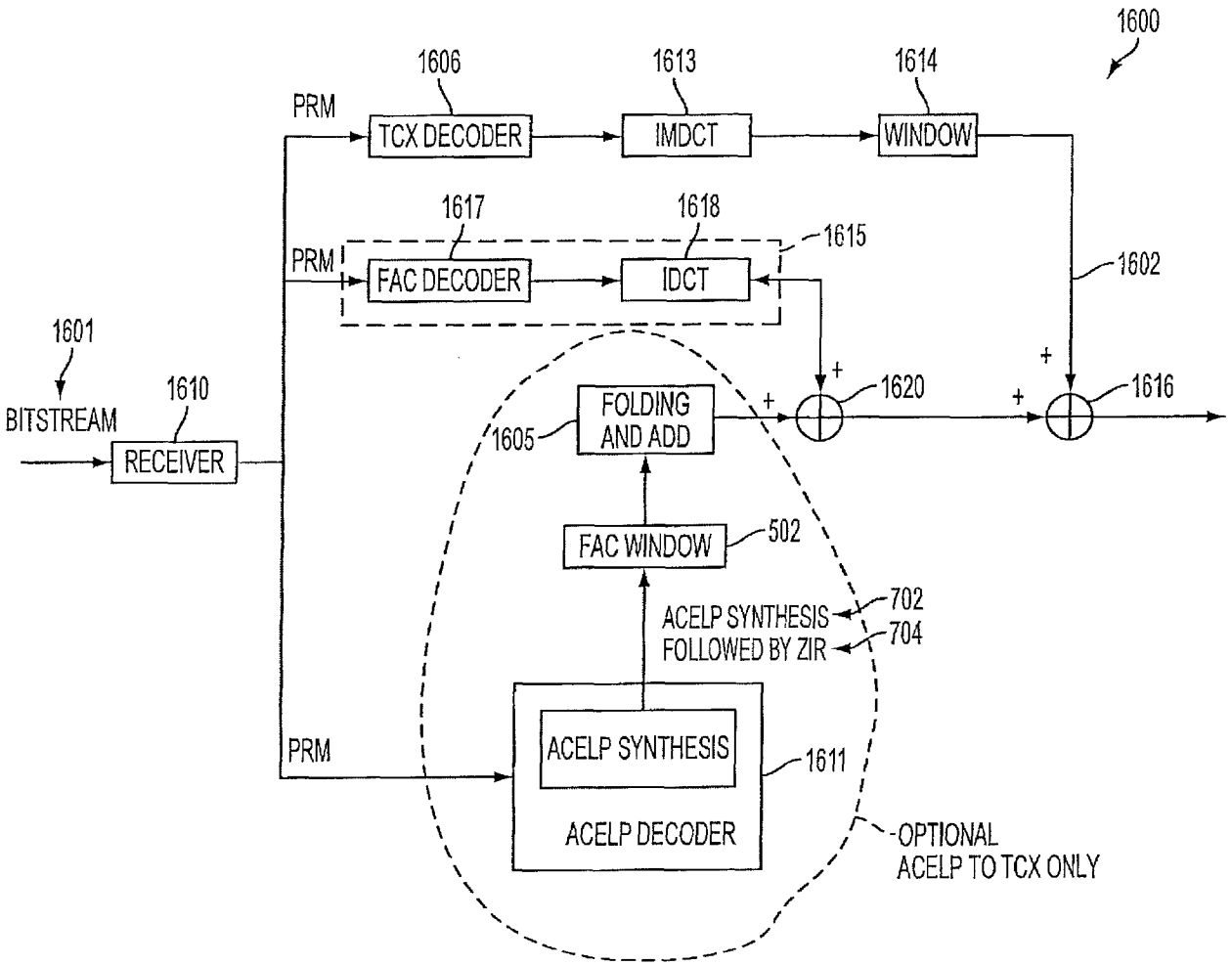
FIG. 16 is a block diagram of an example of device for forward cancelling time-domain aliasing in a coded signal received in a bitstream.

FIG. 16 is a block diagram of a non-limitative example of device 1600 for forward cancelling time-domain aliasing in a coded signal received in a bitstream 1601. The device 1600 is given, for the purpose of illustration, with reference to the FAC correction of FIG. 7 using information from the ACELP mode. Those of ordinary skill in the art will appreciate that a corresponding device 1600 can be implemented in relation to every other example of FAC correction given in the present disclosure.

The device 1600 comprises a receiver 1610 for receiving the bitstream 1601 representative of a coded audio signal including the FAC correction.

ACELP frames from the bitstream 1601 are supplied to an ACELP decoder 1611 including an ACELP synthesis filter. The ACELP decoder 1611 produces a zero-input-response (ZIR) 704 of the ACELP synthesis filter. Also, the ACELP synthesis decoder 1611 produces an ACELP synthesis signal 702. The ACELP synthesis signal 702 and the ZIR 704 are concatenated to form an ACELP synthesis signal followed by the ZIR. The unfolded FAC window 502 is then applied to the concatenated signals 702 and 704, and then folded and added in processor 1605, and then applied to a positive input of an adder 1620 to provide a first (optional) part of the audio signal in TCX frames.

Parameters (prm) for TCX 20 frames from the bitstream 1601 are supplied to a TCX decoder 1606, followed by an IMDCT transform and a window 1613 for the IMDCT, to produce a TCX 20 synthesis signal 1602 applied to a positive input of the adder 1616 to provide a second part of the audio signal in TCX 20 frames.

However, upon a transition between coding modes (for example from an ACELP frame to a TCX 20 frame), a part of the audio signal would not be properly decoded without the use of a FAC canceller 1615. In the example of FIG. 16, the FAC canceller 1615 comprises a FAC decoder 1617 for decoding from the received bitstream 1601 the correction signal 504 (FIG. 5) which corresponds to the correction signal 706 (FIG. 7) after folding as in FIG. 5, and an inverse DCT (IDCT). The output of the IDCT 1618 is supplied to a positive input of the adder 1620. The output of the adder 1620 is supplied to a positive input of the adder 1616.

The global output of the adder 1616 represents the FAC cancelled synthesis signal for a TCX frame following an ACELP frame.

Figure 17:
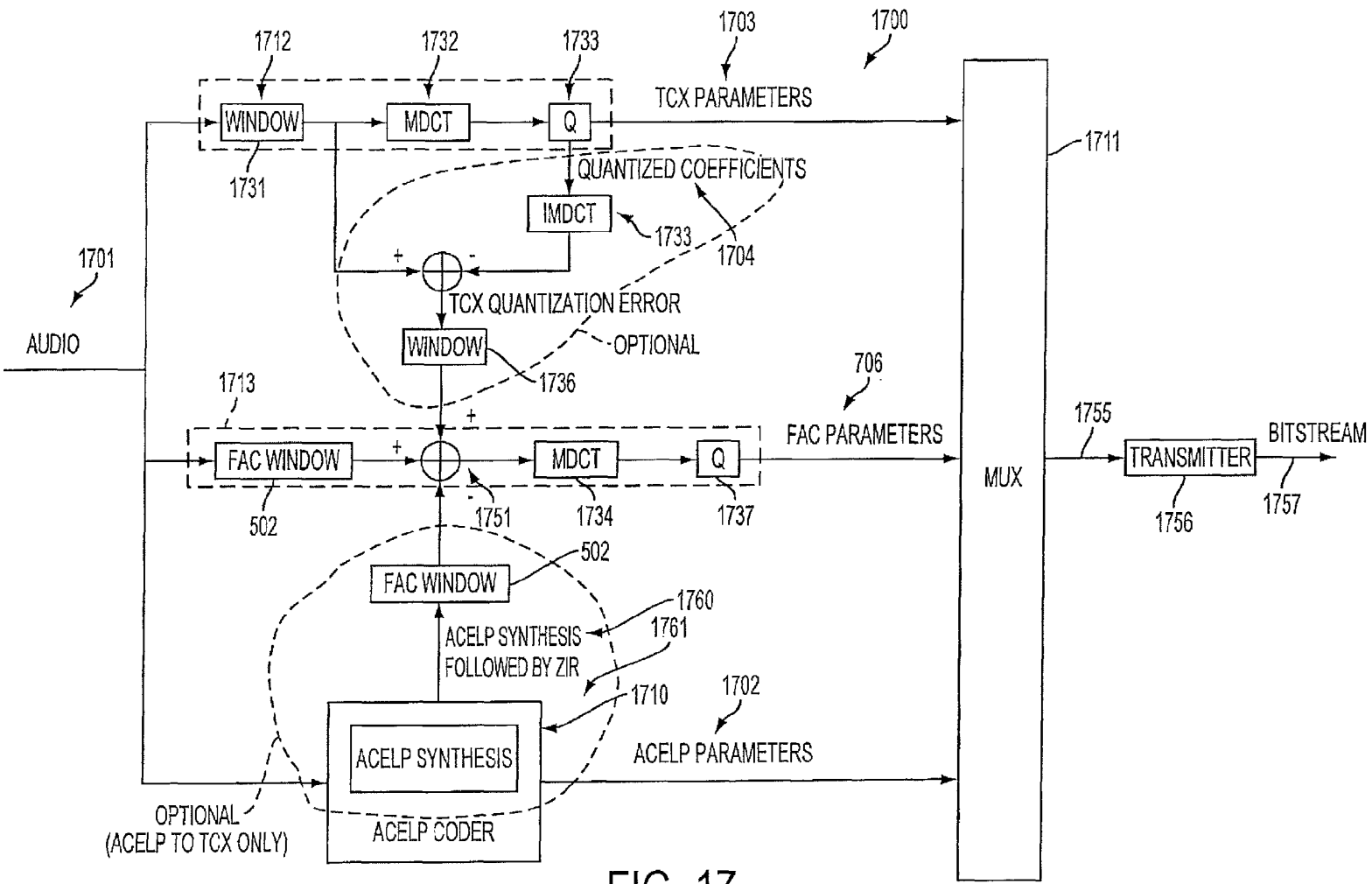
FIG. 17 is a block diagram of an example of device for forward time-domain aliasing cancellation in a coded signal for transmission to a decoder.

FIG. 17 is a block diagram of a non-limitative example of device 1700 for forward time-domain aliasing cancellation in a coded signal for transmission to a decoder. The device 1700 is given, for the purpose of illustration, with reference to the FAC correction of FIG. 7 using information from the ACELP mode. Those of ordinary skill in the art will appreciate that a corresponding device 1700 can be implemented in relation to every other example of FAC correction given in the present disclosure.

An audio signal 1701 to be encoded is applied to the device 1700. A logic (not shown) applies ACELP frames of the audio signal 1701 to an ACELP coder 1710. An output of the ACELP coder 1710, the ACELP-coded parameters 1702, is applied to a first input of a multiplexer (MUX) 1711. Another output of the ACELP coder is an ACELP synthesis signal 1760 followed by the zero-input response (ZIR) 1761 of an ACELP synthesis filter of the coder 1710. A FAC window 502 is applied to the concatenation of signals 1760 and 1761. The output of the FAC window processor 502 is applied at a negative input of an adder 1751.

The logic (not shown) also applies TCX 20 frames of the audio signal 1701 to a MDCT encoding module 1712 to produce the TCX 20 encoded parameters 1703 applied to a second input of the multiplexer 1711. The MDCT encoding module 1712 comprises an MDCT window 1731, an MDCT transform 1732, and quantizer 1733. The windowed input to the MDCT module 1732 is supplied to a positive input of an adder 1750. The quantized MDCT coefficients 1704 are applied to an inverse MDCT (IMDCT) 1733, and the output of IMDCT 1733 is supplied to a negative input of the adder 1750. The output of the adder 1750 forms a TCX quantization error, which is windowed in processor 1736. The output of processor 1736 is supplied to a positive input of an adder 1751. As indicated in FIG. 17, the output of processor 1736 can be used optionally in the device.

Upon a transition between coding modes (for example from an ACELP frame to a TCX 20 frame), some of the audio frames coded by the MDCT module 1712 may not be properly decoded without additional information. A calculator 1713 provides this additional information, more specifically the correction signal 706 (FIG. 7). All components of the calculator 1713 may be viewed as a producer of a FAC correction signal. The producer of a FAC correction signal comprises applying a FAC window 502 to the audio signal 1701, providing the output of FAC window 502 to a positive input of the adder 1751, providing the output of adder 1751 to the MDCT 1734, and quantizing the output of MDCT 1734 in quantizer 1737 to produce the FAC parameters 706 which are applied to an input of multiplexer 1711.

The signal at the output of the multiplexer 1711 represents the encoded audio signal 1755 to be transmitted to a decoder (not shown) through a transmitter 1756 in a coded bitstream 1757.

Those of ordinary skill in the art will realize that the description of the devices and methods for forward cancelling time-domain aliasing in a coded signal are illustrative only and are not intended to be in any way limiting. Other embodiments will readily suggest themselves to such persons with ordinary skill in the art having the benefit of this disclosure. Furthermore, the disclosed systems can be customized to offer valuable solutions to existing needs and problems of cancelling time-domain aliasing in a coded signal.

Those of ordinary skill in the art will also appreciate that numerous types of terminals or other apparatuses may embody both aspects of coding for transmission of coded audio, and aspects of decoding following reception of coded audio, in a same device.

In the interest of clarity, not all of the routine features of the implementations of forward cancellation of time-domain aliasing in a coded signal are shown and described. It will, of course, be appreciated that in the development of any such actual implementation of the audio coding, numerous implementation-specific decisions must be made in order to achieve the developer's specific goals, such as compliance with application-, system-, network- and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of audio coding systems having the benefit of this disclosure.

In accordance with this disclosure, the components, process steps, and/or data structures described herein may be implemented using various types of operating systems, computing platforms, network devices, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used. Where a method comprising a series of process steps is implemented by a computer or a machine and those process steps can be stored as a series of instructions readable by the machine, they may be stored on a tangible medium.

Systems and modules described herein may comprise software, firmware, hardware, or any combination(s) of software, firmware, or hardware suitable for the purposes described herein. Software and other modules may reside on servers, workstations, personal computers, computerized tablets, PDAs, and other devices suitable for the purposes described herein. Software and other modules may be accessible via local memory, via a network, via a browser or other application in an ASP context or via other means suitable for the purposes described herein. Data structures described herein may comprise computer files, variables, programming arrays, programming structures, or any electronic information storage schemes or methods, or any combinations thereof, suitable for the purposes described herein.

Although the present invention has been described hereinabove by way of non-restrictive illustrative embodiments thereof, these embodiments can be modified at will within the scope of the appended claims without departing from the spirit and nature of the present invention.

What is claimed is:

1. A method for forward cancelling time-domain aliasing in a coded signal received in a bitstream at a decoder, comprising:

receiving in the bitstream at the decoder, from a coder, additional information related to correction of the time-domain aliasing in the coded signal, wherein the additional information is representative of a forward aliasing cancellation (FAC) correction signal related to a difference signal based on a difference between a signal to be coded upon transition from a first coding mode to a second coding mode and a synthesis signal obtained using the first coding mode; and in the decoder, cancelling the time-domain aliasing in the coded signal in response to the additional information.

2. The method of claim 1, used in transitions between a frame using a rectangular, non-overlapping window and a frame using a non-rectangular, overlapping window.

3. The method of claim 1, wherein the FAC correction signal is a windowed, or windowed and folded FAC correction signal.

4. The method of claim 1, wherein the FAC correction signal is transform coded using a transform for coding a frame using a non-rectangular, overlapping window.

5. The method of claim 1, wherein the first coding mode is a Code Excited Linear Prediction (CELP) mode and the second coding mode is a transform coding mode.

6. The method of claim 1, wherein the difference signal is based on a difference between the signal to be coded and the synthesis signal concatenated with a zero-input response of a synthesis filter of the first coding mode.

7. The method of claim 1, wherein cancelling the time-domain aliasing comprises, at the decoder:

decoding the difference signal; and re-computing the FAC correction signal using the synthesis signal and the decoded difference signal.

8. The method of claim 1, wherein cancelling the time-domain aliasing comprises, at the decoder:

decoding the FAC correction signal; and adding the decoded FAC correction signal to the coded signal.

9. The method of claim 1, wherein the FAC correction signal is quantized using scale factors used in non-rectangular, overlapping windows.

10. A method for forward cancelling time-domain aliasing in a coded signal for transmission from a coder to a decoder, comprising:

in the coder, calculating additional information related to correction of the time-domain aliasing in the coded signal, wherein calculating the additional information comprises producing a forward aliasing cancellation (FAC) correction signal related to a difference signal based on a difference between a signal to be coded upon transition from a first coding mode to a second coding mode and a synthesis signal obtained using the first coding mode; and sending in a bitstream, from the coder to the decoder, the additional information related to the correction of the time-domain aliasing in the coded signal.

11. The method of claim 10, used in transitions between a frame using a rectangular, non-overlapping window and a frame using a non-rectangular, overlapping window.

12. The method of claim 10, wherein calculating the additional information comprises windowing, or windowing and folding the FAC correction signal.

13. The method of claim 10, wherein calculating the additional information comprises transform coding the FAC correction signal using a transform for coding a frame using a non-rectangular, overlapping window.

14. The method of claim 10, wherein the first coding mode is a Code Excited Linear Prediction (CELP) mode and the second coding mode is a transform coding mode.

15. The method of claim 10, wherein the difference signal is based on a difference between the signal to be coded and the synthesis signal concatenated with a zero-input response of the synthesis filter of the first coding mode.

16. The method of claim 10, comprising quantizing the FAC correction signal using scale factors used in non-rectangular, overlapping windows.

17. The method of claim 16, comprising subtracting a quantization error of a transform-coded frame from the FAC correction signal prior to quantization of the FAC correction signal.

18. A device for forward cancelling time-domain aliasing in a coded signal received in a bitstream, comprising:

a receiver, from a bitstream from a coder, of additional information related to correction of the time-domain aliasing in the coded signal, wherein the additional information comprises a forward aliasing cancellation (FAC) correction signal related to a difference signal based on a difference between a signal to be coded upon transition from a first coding mode to a second coding mode and a synthesis signal obtained using the first coding mode; and a canceller of the time-domain aliasing in the coded signal in response to the additional information.

19. The device of claim 18, used in transitions between a frame using a rectangular, non-overlapping window and a frame using a non-rectangular, overlapping window.

20. The device of claim 18, wherein the FAC correction signal is a windowed, or windowed and folded FAC correction signal.

21. The device of claim 18, wherein the FAC correction signal is transform coded using a transform for coding a frame using a non-rectangular, overlapping window.

22. The device of claim 18, wherein the first coding mode is a Code Excited Linear Prediction (CELP) mode and the second coding mode is a transform coding mode.

23. The device of claim 18, wherein difference signal is based on a difference between the signal to be coded and the synthesis signal concatenated with a zero-input response of a synthesis filter of the first coding mode.

24. The device of claim 18, wherein the canceller, at the decoder:

decodes the difference signal; and re-computes the FAC correction signal using the synthesis signal and the decoded difference signal.

25. The device of claim 18, wherein the canceller, at the decoder:

decodes the FAC correction signal;

adds the decoded FAC correction signal to the coded signal.

26. The device of claim 18, wherein the FAC correction signal is quantized using scale factors used in non-rectangular, overlapping windows.

27. A device for forward time-domain aliasing cancellation in a coded signal for transmission to a decoder, comprising:

a calculator of additional information related to correction of the time-domain aliasing in the coded signal, wherein the calculator of the additional information comprises a producer of a forward aliasing cancellation (FAC) correction signal related to a difference signal based on a difference between a signal to be coded upon transition from a first coding mode to a second coding mode and a synthesis signal obtained using the first coding mode; and a transmitter for sending in the bitstream, to a decoder, the additional information related to the correction of the time-domain aliasing in the coded signal.

28. The device of claim 27, used in transitions between a frame using a rectangular, non-overlapping window and a frame using a non-rectangular, overlapping window.

29. The device of claim 27, wherein the producer of the FAC correction signal windows, or windows and folds the FAC correction signal.

30. The device of claim 27, wherein the producer of the FAC correction signal transform codes the FAC correction signal using a transform for coding a frame using a non-rectangular, overlapping window.

31. The device of claim 27, wherein the first coding mode is a Code Excited Linear Prediction (CELP) mode and the second coding mode is a transform coding mode.

32. The device of claim 27, wherein the difference signal is based on a difference between the signal to be coded and the synthesis signal concatenated with a zero-input response of the synthesis filter of the first coding mode.

33. The device of claim 27, comprising a quantizer of the FAC correction signal using scale factors used in non-rectangular, overlapping windows.

34. The device of claim 33, comprising a subtractor of an error of a synthesized TCX frame from the FAC correction signal prior to quantization of the FAC correction signal.

* * * * *